US007284902B2

(12) United States Patent
Hosozawa

(10) Patent No.: US 7,284,902 B2
(45) Date of Patent: Oct. 23, 2007

(54) MIXING TUBE AND METHOD OF MANUFACTURING THE MIXING TUBE

(75) Inventor: Taro Hosozawa, Chiyoda-Ku (JP)

(73) Assignee: Maeda Corporation, Chiyoda-Ku (JP)

( * ) Notice: Subject to any disclaimer, the term of this patent is extended or adjusted under 35 U.S.C. 154(b) by 132 days.

(21) Appl. No.: 10/767,753

(22) Filed: Jan. 29, 2004

(65) Prior Publication Data

US 2004/0195266 A1 Oct. 7, 2004

(30) Foreign Application Priority Data

Jan. 30, 2003 (JP) ..... 2003-022098
Nov. 13, 2003 (JP) ..... 2003-383664

(51) Int. Cl.
*B01F 5/06* (2006.01)

(52) U.S. Cl. ..... 366/336; 366/340

(58) Field of Classification Search ..... 366/336, 366/340

See application file for complete search history.

(56) References Cited

U.S. PATENT DOCUMENTS

| | | | | | |
|---|---|---|---|---|---|
| 3,206,170 | A | | 9/1965 | Schippers et al. | |
| 3,286,992 | A | | 11/1966 | Armeniades et al. | |
| 3,476,521 | A | * | 11/1969 | Wise | 366/336 |
| 3,927,868 | A | * | 12/1975 | Moore | 206/221 |
| 4,002,289 | A | * | 1/1977 | Moore | 206/219 |
| 4,130,245 | A | * | 12/1978 | Bryson | 239/34 |
| 4,538,920 | A | | 9/1985 | Drake | |
| 4,952,068 | A | * | 8/1990 | Flint | 366/337 |
| 5,154,321 | A | * | 10/1992 | Shomer | 222/129 |
| 5,516,209 | A | * | 5/1996 | Flint et al. | 366/340 |
| 5,826,981 | A | * | 10/1998 | Fowler et al. | 366/336 |
| 6,135,632 | A | * | 10/2000 | Flint | 366/340 |

FOREIGN PATENT DOCUMENTS

| | | | |
|---|---|---|---|
| JP | 09-253467 | | 9/1997 |
| JP | 2000-000452 | | 1/2000 |
| JP | 2000-070690 | | 3/2000 |
| JP | 2003-001078 | A1 | 1/2003 |
| JP | 2003-001078 | * | 7/2003 |

OTHER PUBLICATIONS

Patent Abstract of Japan, for Japan Application Publication No. 2003-001078 to Hosozawa, published Jul. 1, 2003, 2 pages.*

* cited by examiner

*Primary Examiner*—Tony G. Soohoo
(74) *Attorney, Agent, or Firm*—Burr & Brown

(57) ABSTRACT

A mixing tube is provided, including first and second mixing passages, each of which include a plurality of elements connected in series and having a sectional shapes that change continuously. Multi-component materials pass through the first and the second mixing passage, repeatedly dividing and aggregating the materials in a passing process. The first and the second mixing passages are formed by a first outer frame member, a second outer frame member, and a partition member. The first and the second mixing passages repeatedly divide and aggregate due to the hole portions in the partition member, and with this mixing tube, the materials to be mixed pass trough the mixing passages by continuing and manually squeezing the mixing tube from the inlet port to the outlet port of the first and the second mixing passages, and sufficient mixing can be obtained.

7 Claims, 12 Drawing Sheets

MIXING TUBE AND METHOD OF MANUFACTURING THE MIXING TUBE

This application claims the benefit of Japanese Application 2003-22098, filed Jan. 30, 2003, and Japanese Application 2003-383664, filed Nov. 13, 2003, the entireties of which are incorporated herein by reference.

BACKGROUND OF THE INVENTION

1. Field of the Invention

The present invention relates to a mixing tube and to a method of manufacturing the mixing tube. In particular, the present invention relates to a technique which can be suitably employed for a mixing tube used for mixing two types of fluids during production of a two-component reactive adhesive such as an epoxy adhesive, a polyurethane adhesive, or a silicon adhesive, or a sealant or a packing material.

2. Description of the Related Art

A two-component adhesive consists of base and catalyst agents which are prepared separately, and the base and catalyst agents are mixed together in use. Conventionally, the base and catalyst agents are mixed by employing a manual method using a knife, a spatula, or the like, a method that utilizes a dispenser using a static mixer, or a method that uses a specially designed mixer.

However, the following problems exist when performing mixing of materials by using the conventional methods. Hardening of the base agent and the catalyst agent in a two-component adhesive begins upon mixing of the base agent with the catalyst agent, and curing occurs even at room temperature. Therefore, there are occasions where the materials adhere to the knife, the spatula, inner portions of the static mixer, and containers within the specially designed mixer after one time usage. Therefore, the whole mixture cannot be used for its original purpose as an adhesive, resulting in disposal of the cured material.

Further, the degree of mixing performed by an operator depends on the judgement of the operator, and there is a problem in that differences develop in the quality of the resultant mixtures.

In view of the above-mentioned problems, the applicant of the present invention has already invented a mixing tube for mixing multi-component materials. This mixing tube manufactured from a flexible material, such as, a plastic film or the like, wherein a residual material, after mixing tube materials, remained inside the mixing tube can be squeezed out by squeezed the mixing tube. In this prior invention, plural containers that separately receive multi-component materials are provided to the mixing tube, and the multi-component materials are discharged from the plural containers. The features of the mixing tube are as follows. The mixing tube has an inlet port for mounting there to the containers that receive multi-component materials, a mixing passage for mixing multi-component materials that are injected from the inlet port, and an outlet port discharging the multi-component materials which have been mixed in the mixing passage. By continuously squeezing the mixing passage from the inlet port toward the outlet port of the mixing passage, the multi-component materials injected from the inlet port pass through the mixing passage to be mixed, and then are discharged from the outlet port (refer to JP 2003-001078 A).

The mixing passage of the mixing tube may be configured, for example, by connecting plural passage blocks in series, the passage blocks having the same number of deformed passages as the number of the materials to be mixed, and by suitably connecting the outlet port and the inlet port of each of the deformed passages at the connection portions of the passage blocks in order to repeat the operation of dividing the materials to be mixed that are discharged from a prior stage passage block at the inlet port to a subsequent stage passage block, and aggregating materials to be mixed at the outlet port. If the number of passage block connections is taken as N, the materials to be mixed are divided $2^N$ times, and thus allowing sufficient mixing.

However, the configuration of the conventional mixing tube, with which the materials to be mixed are theoretically mixed $2^N$ times, is complex. The configuration is difficult to reproduce, and difficult to manufacture. This type of mixing tube is therefore expensive and not suited to mass production.

SUMMARY OF THE INVENTION

The present invention is made in view of the above-described problems. An object of the present invention is to provide a mixing tube tat has a relatively simple structure, and that is capable of dividing, aggregating, and sufficiently mixing multi-component materials. This mixing tube is manufactured from a flexible material, such as; a plastic film or the like, wherein a residual material; that remains inside the mixing tube after mixing tube materials can be squeezed out by saueezing the mixing tube.

In order to solve the above-mentioned technical problems, a mixing tube according to the present invention has the following structure. The mixing tube includes a first mixing passage and a second mixing passage for mixing the materials to be mixed, and causes multi-component materials to pass through the first mixing passage and the second mixing passage, repeatedly dividing and aggregating the materials tote mixed by passing them though the mixing passages. The first mixing passage and the second mixing passage are formed by a first outer frame member, a second outer frame member, and a partition member that is interposed between the first and second outer frame members, the three members dividing the mixing tube in a direction toward which the materials to be mixed pass, and holes are formed at fixed intervals in the partition member in a direction of mixing which the materials. The first mixing passage and the second mixing passage repeatedly divide and aggregate the materials due to the holes, thereby the materials are divided and aggregated repeatedly.

With the above described structure, the materials to be mixed pass through the first and the second mixing passages, and through the holes of the partition member, and the materials are divided and aggregated, to thereby to be mixed sufficiently. The mixing tube is configured by three members including the first outer frame member, the second outer frame member, and the partition member, and they can be configured and assembled easily and simply. Further, there are no limitations to the sectional shapes of the first and the second outer frame members, and the shapes may be rectangular, circular, rhombic, or the like. That is, there are no limitations to the sectional shapes so long as the plurality of mixing passages formed in the mixing tube repeatedly divide and merge together the materials to be mixed through the partition member having the holes.

One method of using the mixing tube according to the present invention is, for example, to squeeze the mixing tube manually by hand or the like, thus squeezing out the materials to be mixed. Accordingly, materials having flexibility and that are capable of being squeezed with a predetermined force are suitable for the mixing tube material.

According to the mixing tube, the materials to be mixed in within the mixing tube pass through the mixing passages by continuing to manually squeeze the mixing tube by hand from the inlet ports to the outlet ports side of the first and the second mixing passages, thereby sufficient mixing can be performed. Further, the materials to be mixed within the mixing tube can be substantially completely squeezed out by fully squeezing the mixing tube to tips of the outlet ports of the mixing passages.

Furthermore, the first mixing passage and the second mixing passage of the mixing tube according to the present invention have a plurality of elements whose sectional shapes change continuously, and that are connected in series. The holes of the partition member are formed to have a size that is equal to half the length of each of the elements in the direction of mixing the materials.

According to the above described structure, a compressive force and a shear force are continuously applied to the materials to be mixed as they pass through each of the elements having the sectional shape that changes continuously. Further, the holes, each having a size equal to half the length of each of the elements, are formed in the partition member, and therefore the materials to be mixed that pass through each of the deformed passages arc regularly divided and merged together. That is, the materials to be mixed continuously receive compressive forces and shear forces as they pass through the mixing passages, and in addition, the materials to be mixed are regularly divided and merged together with the materials to be mixed that pass through other mixing passages. The mixing passages thus mix the multi-component materials uniformly.

In addition, it is desirable that the mixing tube according to the present invention further includes flange portions provided in joining portions where the first outer frame member, the second outer frame member, and the partition member are joined, wherein the flange portions being formed along, and outside of, the first mixing passage and the second mixing passage, in which the flange portion of the partition member is sandwiched between the flange portions of the first outer frame member and the second outer frame member, thus integrating the first outer frame member, the second outer frame member, and the partition member and forming the first mixing passage and the second mixing passage.

According to the above-described configuration, the first outer frame member, the second outer frame member, and the partition member can easily be integrated. That is, it becomes possible to easily form the first and the second mixing passages, which are capable of sufficiently mixing the materials to be mixed, by using a relatively simple configuration.

Furthermore, it is desirable that the mixing tube according to the present invention includes intermediate partitions provided in the first outer frame member and the second outer frame member, for dividing the first mixing passage and the second mixing passage, in which the intermediate partitions of the first outer frame member and the second outer frame member are welded in the holes of the partition member.

The first mixing passage and the second mixing passage can each be divided by providing the intermediate partitions described above. An operation can be repeated by which the materials to be mixed, having been discharged from the elements, are divided at the inlet ports of the subsequent elements, and then merged together at the outlet ports of the elements. According to this mixing tube, if the number of elements connected is taken as N, then the materials to be mixed are divided $2^N$ times, thereby to be possible to perform sufficient mixing. Further, a complete intermediate partitions are formed by welding the intermediate partitions of the first outer frame member and the intermediate partitions of the second outer frame member. It thus becomes possible to form the complete intermediate partitions at the same time will forming the first mixing passage and the second mixing passage. An example of the configuration of the intermediate partitions may be such that the cross sections in the longitudinal direction of the first outer frame member and the second outer frame member are formed in a substantially "M" shape. In addition, it is preferable that the intermediate partitions be formed perpendicular to the partition member that are interposed between the first outer frame member and the second outer frame member, and that the intermediate partitions be disposed in the center of the partition member. It becomes possible to reliably divide the first and the second mixing passages into two sections by thus forming the intermediate partition portions.

The mixing tube according to the present invention may have intermediate partitions provided in the first outer frame member and the second outer frame member for dividing the first mixing passage and the second mixing passage respectively, and the intermediate partitions of the first outer frame member and the second outer frame member are each welded to the partition member.

The intermediate partitions may also be formed in a state of dividing the first mixing passage and the second mixing passage, respectively, by welding the intermediate partitions of the first outer frame member and the intermediate partitions of the second outer frame member to the partition member. Accordingly, an operation can be repeated by which the materials to be mixed, which have been discharged from the elements, are divided at the inlet ports to the subsequent elements and then merged together at the outlet ports of the elements. If the number of elements connected are taken as N, then the materials to be mixed are divided $2^N$ times by the mixing tube, and it becomes possible to perform sufficient mixing.

Furthermore, it is preferable that the mixing tube according to the present invention includes joining portions provided in the holes of the partition member, the joining portions are contact with the intermediate partitions of the first outer frame member and the second outer frame member, wherein the joining portions are welded to the intermediate partitions of the first outer frame member and the second outer frame member.

By forming the joining portions described above, the intermediate partitions of the first outer frame member and the second outer frame member are reliably fixed to the partition member. It becomes possible to form the intermediate partitions in a state where the first mixing passage and the second mixing passage are divided. Further, the intermediate partitions of the first outer frame member and the intermediate partitions of the second outer frame member can each be fixed to the joining portions. It therefore becomes possible to use various types of manufacturing methods.

A method of manufacturing a mixing tube according to the present invention comprises: molding a first outer frame member and a second outer frame member that are made out of a thermoplastic resin; forming holes in a partition member that is made out of a thermoplastic resin; welding end portions of flanges of the partition member, the first outer frame member, and the second outer frame member, while the flanges of the first outer frame member and the second outer frame member sandwiching the flanges of the partition member, thus integrating the first outer frame member, the second outer frame member, and the partition member, and forming a first mixing passage and a second mixing passage.

According to the configuration described above, it is possible to form the mixing passages by welding the flanges, causing them to adhere together, whereby it is thus possible to easily manufacture the mixing tube. Furthermore, the term of thermoplastic resin denotes substances that soften and melt when heated, and harden when cooled. Serene resins, acrylic resins, cellulose resins, polyethylene resins, vinyl resins, nylon resins, fluorocarbon resins, and the like may be given as examples of thermoplastic resins.

Methods of welding a thermoplastic resin are explained here. The methods can be roughly divided as follows: a high frequency welding where an object to be heated is made to emit heat by itself due to electric potential movement at a molecular or electron level according to a high frequency electrolytic action of several tens of megahertz; an ultrasonic welding where ultrasonic vibrations at ultrasonic energy having a frequency equal to or greater than 20 kHz are transmitted to an object to be heated from a resonator referred to as a horn, thus generating strong frictional heating and welding the object; and a thermal welding where the object to be welded is heated by thermal conduction from a heat source located outside of the object to be heated. In addition, a convection welding, a hot plate welding, an impulse welding, and welding by using an iron can be given as examples of the thermal welding. Any type of welding method may be used by the present invention, so long as the method can weld the first outer frame member, the second outer frame member, and the partition member.

In addition, it is preferable that in the method of manufacturing a mixing tube according to the present invention, the first outer frame member and the second outer frame member are molded, while forming intermediate partitions that divide the first mixing passage and the second mixing passage, and the intermediate partitions and the partition member are welded, or the intermediate partitions are welded together. A mixing tube in which the first mixing passage and the second mixing passage are each divided can be formed by melt bonding the intermediate partitions and the partition member, or by welding the intermediate partitions together. Further, the welding of the intermediate partitions can be performed at the time of welding of the first outer frame member, the second outer frame member, and the partition member, and therefore manufacturing can be performed efficiently.

Furthermore, the method of manufacturing a mixing tube according to the present invention comprises: molding a first outer frame member and a second outer frame member that are made out of a thermoplastic resin, while forming intermediate partitions for dividing a first mixing passage and a second mixing passage; forming holes in partition members that are made out of a thermoplastic resin while forming joining portions that are contact with the intermediate partitions of the first outer frame member and the second outer frame member; a first step of welding flanges of the first outer frame member and flanges of the partition member; a second step of welding flanges of the second outer frame member and flanges of the partition member; and a third step of welding flanges of the members manufactured in the first step and the second step. According to this manufacturing method, the partition members are welded to the first outer frame member and the second outer frame member. Adhering the first outer member and the partition member, and adhering the second outer member and the partition member, are then welded to the flanges. That is, manufacturing can be divided up and performed in separate steps compared to a manufacturing method in which the three types of members are welded at the same time. It therefore becomes possible to perform each of the manufacturing steps with ease.

In addition, the method of manufacturing a mixing tube according to the present invention comprises: molding a first outer frame member and a second outer frame member that are made out of a thermoplastic, resin while forming intermediate partitions for dividing a first mixing passage and a second mixing passage; forming holes in partition members that are made out of a thermoplastic resin, while forming joining portions that are in contact with the intermediate partitions of the first outer frame member and the second outer frame member; a first step of welding flanges of the first outer frame member and flanges of the partition member, and welding the intermediate partitions of the first outer frame member and the joining portions of the partition member; a second step of welding flanges of the second outer frame member and flanges of the partition member, and welding the intermediate partitions of the second outer frame member and the joining portions of the partition member; and a third step of welding flanges of the members manufactured in the first step and the second step. According to this manufacturing method as well, the partition members are welded to the first outer frame member and the second outer frame member. Adhering first outer frame member and partition member, and adhering second outer frame member and partition member, are then welded to the flanges. That is, manufacturing can be divided up and performed in separate steps compared to a manufacturing method in which the three types of members are welded at the same time. It therefore becomes possible to perform each of the manufacturing steps with ease.

In addition, a member that is connected to container containing the materials to be mixed, and a jig for adjusting the shape of the materials to be mixed that are injected and discharged, may also be manufactured with the present invention at the same time as welding of the flanges is performed. Operations for injecting and discharging the materials to be mixed can be performed easily if, for example, a jig that widens the width for easy injection of the materials to be mixed, and a jig that throttles the materials to be mixed in order to discharge the materials to an appropriate location, are provided in an inlet port and an outlet port, respectively, of the mixing tube.

A mixing tube that divides and merges together the materials to be mixed, thereby sufficiently mixing the materials to be mixed, can thus be provided by using a relatively simple structure according to the present invention. Furthermore, because the structure is a simple one, it becomes possible to easily perform mass production of the mixing tubes, which has conventionally been difficult.

DETAILED DESCRIPTION OF THE INVENTION

Figure 1:
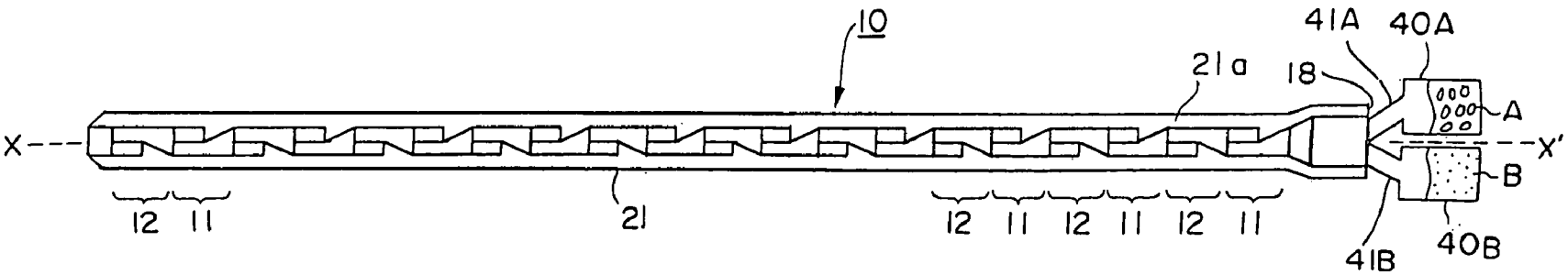
FIG. 1 is a plan view of a mixing tube according to an embodiment mode of the present invention.

An embodiment mode of a mixing tube according to the present invention, and a method of manufacturing the mixing tube, will be described in detail below with reference to the drawing.

Figure 2:
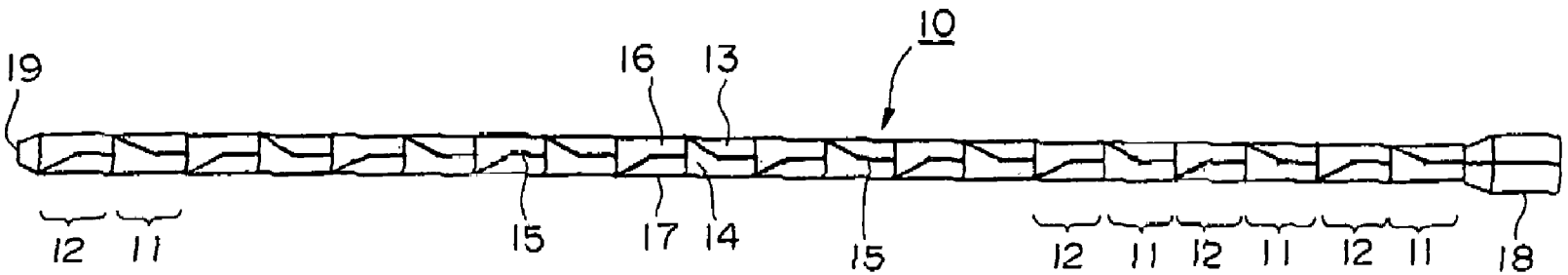
FIG. 2 is a sectional diagram of the mixing tube according to the embodiment mode of the present invention, taken along a line X-X'.

FIG. 1 is a plan view of a mixing tube 10 according to this embodiment mode, and FIG. 2 is a sectional view of the mixing tube 10 shown in FIG. 1, taken along a line X-X'. Two types of materials A and B having fluidity to be mixed are separately contained in plural containers 40A and 40B, which are mounted at one end of the mixing tube 10. The mixing tube is a tube for mixing the materials A and B to be mixed that are pushed out from the containers 40A and 40B containing materials to be mixed. The mixing tube 10 is formed of a soft thermoplastic resin which can be squeezed over its entirety with a predetermined force.

Further, the mixing tube 10 consists of two types of passage blocks, first passage blocks 11 and second passage blocks 12, connected alternately and in series. An injection port 18 that communicates with the containers 40A and 40B containing materials to be mixed, and that injects the materials A and B to be mixed into deformed passages of the mixing tube 10, is provided to one of the first passage blocks 11 at one end of the series connection. A discharge port 19, through which the materials A and B to be mixed having been mixed are discharged, is provided to one of the second passage blocks 12 at the other end of the series connection.

Further, the containers materials 40A and 40B containing to be mixed have connection portions 41A and 41B for connection with the injection port 18 of the mixing tube 10.

Figure 3:
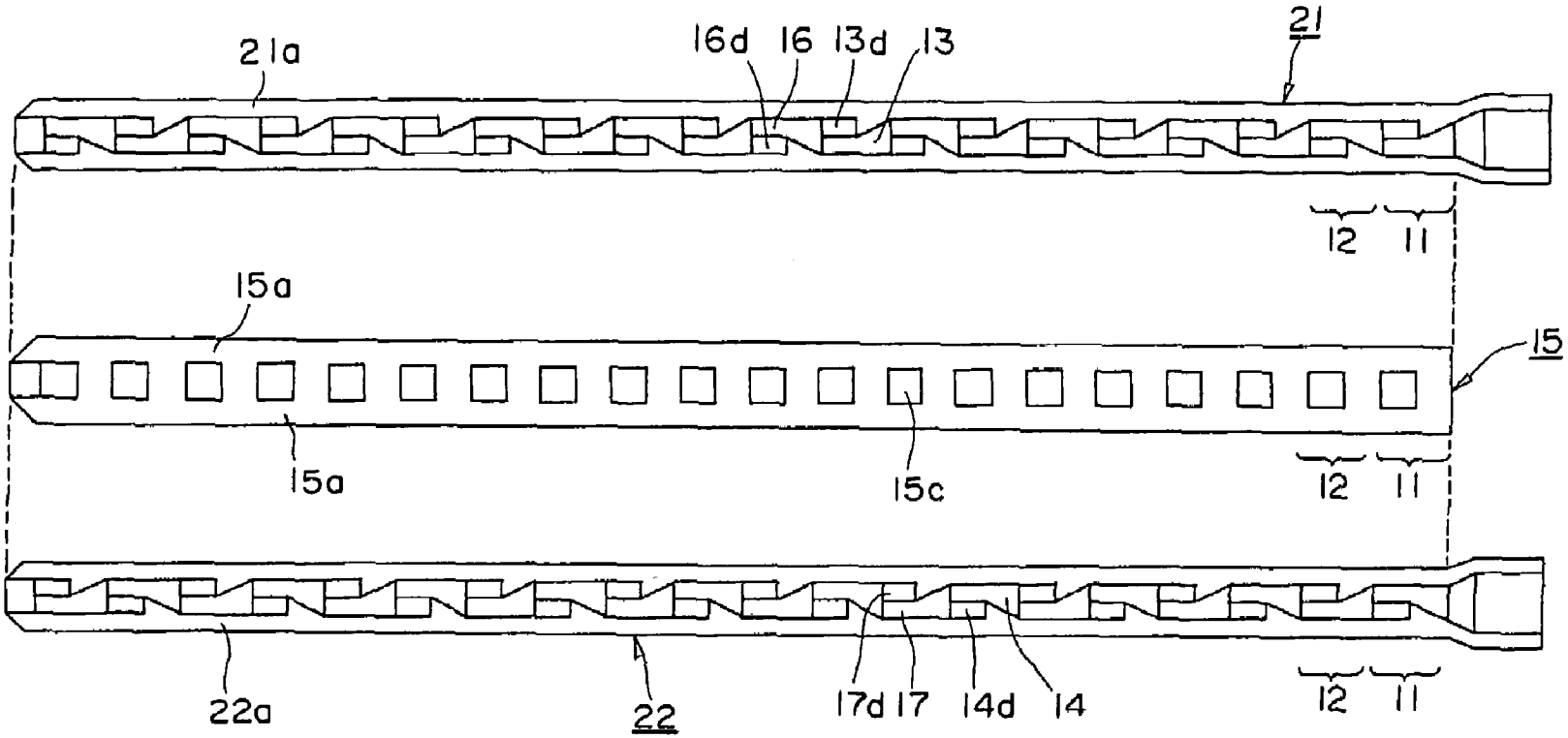
FIG. 3 is a plan view in which the mixing tube according to the embodiment mode of the present invention is exploded into a first outer frame member, a second outer frame member, and a partition member.

Deformed passages 13 and 14 for mixing, and deformed passages 16 and 17 for mixing, are formed inside the first passage blocks 11 and the second passage blocks 12, respectively. The deformed passages are formed by a partition member 15 that is disposed vertically between a first outer frame member 21 and a second outer frame member 22 in a direction toward which the materials to be mixed pass through. FIG. 3 is a plan view of the mixing tube 10 exploded into the first outer frame member 21, the second outer frame member 22, and the partition member 15.

The first outer frame member 21 has voids where the deformed passages 13 of the first passage blocks 11 and the deformed passages 16 of the second passage blocks 12 are formed. Flanges 21*a* are provided in the first outer frame member 21 at both ends in the longitudinal direction thereof in order to be welded to the second outer frame member 22 and the partition member 15. Further, the second outer frame member 22 has voids where the deformed passages 14 of the first passage blocks 11 and the deformed passages 17 of the second passage blocks 12 are formed. Flanges 22*a* are provided in the second outer frame member 22 at both ends in the longitudinal direction thereof in order to be welded to the first outer frame member 21 and the partition member 15. Holes 15*c*, each having the same size as one another and each of which is half the size of each of the passage blocks, are formed at fixed intervals in the partition member 15. As shown, each holes 15*c* has a polygonal outer perpheral shape. Flanges 15*a* are provided in the partition member 15 at both ends in the longitudinal direction thereof in order to be welded to the first outer frame member 21 and the second outer frame member 22.

Figure 4:
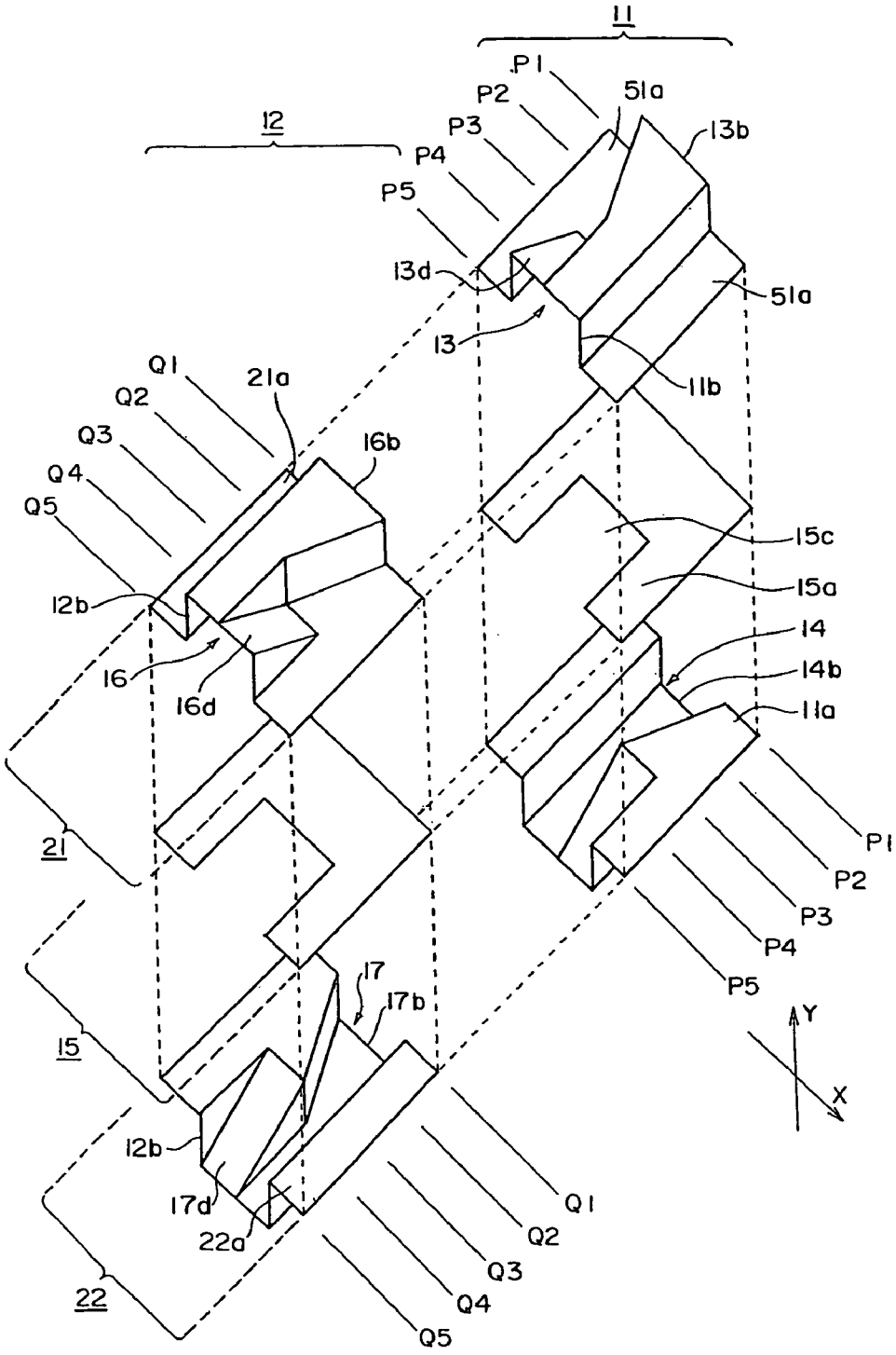
FIG. 4 is a perspective view that shows a first passage block and a second passage block of the mixing tube according to the embodiment mode of the present invention.
Figure 5A:
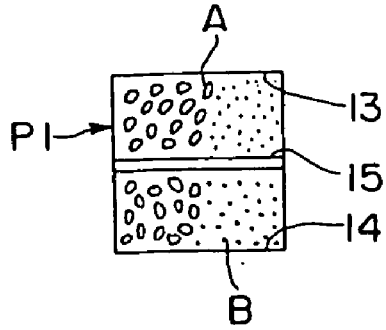
FIGS. 5A to 5E are diagrams explaining mixing states of the first passage block of the mixing tube according to the embodiment mode of the present invention.
Figure 5B:
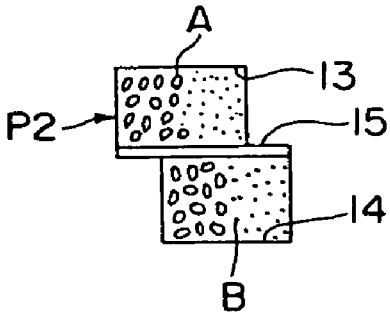
Figure 5C:
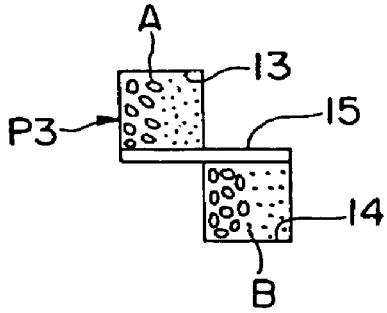
Figure 5D:
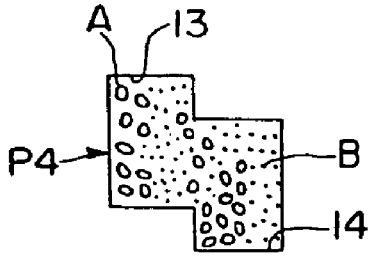
Figure 5E:
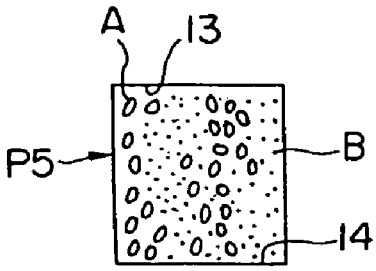
Figure 6:
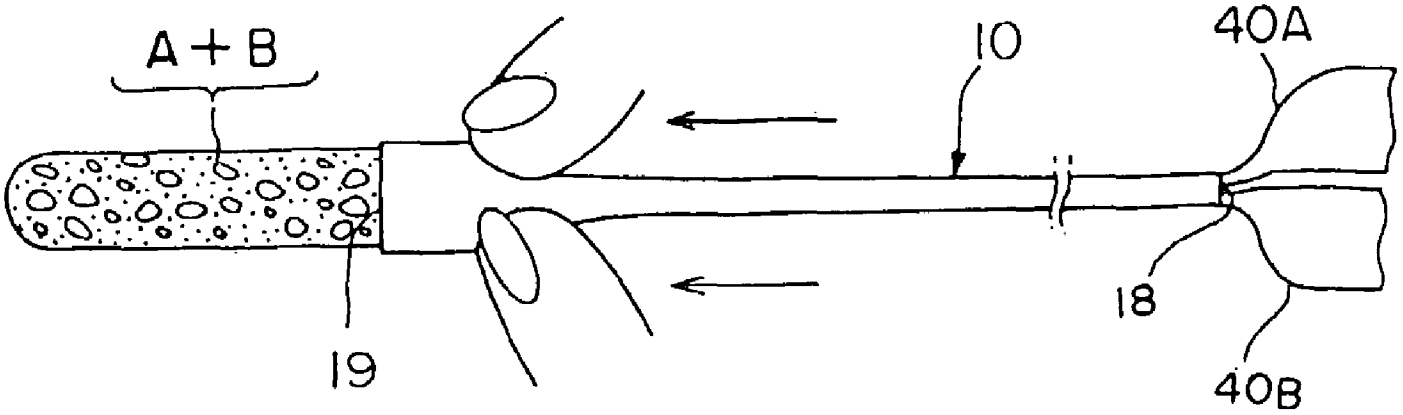
FIG. 6 is a diagram explaining a method of using the mixing tube according to the embodiment mode of the present invention.

Further, FIG. 4 is a perspective view in which the first passage block and the second passage block of the mixing tube are exploded into each of the deformed passages. The deformed passages 13 and 14 of the first passage block 11 have rectangular inlet ports 13*b* and 14*b*, respectively, whose longer sides are in an X direction. One square is formed by overlapping and joining the inlet ports 13*b* and 14*b*. Further, an outlet port 11*b* has a square shape, and the holes 15*c* are formed in the partition member 15 between the two passages, thus forming one outlet port 11*b*.

The deformed passages 13 and 14 have sectional shapes and sectional areas that continuously change from an inlet point P1 toward an outlet point P5. The deformed passages 13 and 14 respectively take on a shorter sided square shape at an intermediate point P3 between the inlet point P1 and the outlet point P5 (refer to FIGS. 5A to 5E) compared with the side lengths at the inlet point. Further, the partition member 15 is disposed between the deformed passages 13 and 14 from the inlet point P1 to the intermediate point P3, dividing the deformed passages 13 and 14 into two portions. However, the holes 15*c* are formed in the partition member 15 between the deformed passages 13 and 14 from the intermediate point P3 to the outlet point P5. Further, the deformed passages 13 and 14 are each divided in half from the intermediate point P3 to the outlet point P5 and one of the deformed passages 13*d* and 14*d* has an inclined surface. The sectional areas of the deformed passages 13 and 14 become gradually larger from the intermediate point P3 to the outlet point P5. That is, the two deformed passages 13 and 14 gradually merge from the intermediate point P3 toward the outlet point P5, and become one square shape passage at the outlet port 11*b*.

Next, the second passage block 12 has the deformed passages 16 and 17. The deformed passages 16 and 17 are disposed opposite to the deformed passages 13 and 14 of the first passage block. The outlet port 11*b* of the deformed passages 13 and 14 in the first passage block 11 at upstream side thus communicates with the inlet ports 16*b* and 17*b* of the deformed passages 16 and 17 in the second passage block at downstream side, at a portion that connects the first passage block 11 and the second passage block 12.

The materials A and B to be mixed that are mixed in the first passage block 11 are then divided in half at the inlet ports 16*b* and 17*b* of the deformed passages 16 and 17 of the second passage block 12. The materials A and B to be mixed are mixed in each of the deformed passages 16 and 17 from an inlet point Q1 to an intermediate point Q3. Further, the holes 15*c* are formed in the partition member 15 between the intermediate point Q3 and an outlet point Q5 in the second passage block 12, similar to the first passage block 11. In addition, the deformed passages 16 and 17 are each divided in half and respective deformed passages 16*d* and 17*d* have inclined surfaces. The materials A and B to be mixed, which are mixed in each of the deformed passages 16 and 17 between the intermediate point Q3 and the outlet port point Q5, thus merge and mix. Repeating the procedure of mixing and dividing allows the materials A and B to be mixed to be uniformly mixed.

Mixing states of the materials A and B to be mixed, when passing through the first passage block 11 and the second passage block 12 that are connected in series will be explained next. States where the materials A and B to be mixed pass through the first passage block 11 are shown in FIGS. 5A to 5E. Note that the reference symbols P1 to P5 in FIGS. 5A to 5E correspond to material passage positions of the first passage block 11 in FIG. 4, and are sectional views in the material passage positions as seen from the inlet ports. Further, the reference symbols A and B denote the materials to be mixed.

As shown in FIG. 5(*a*), the materials A and B to be mixed that are injected into the first passage blocks 11 from the containers 40A and 40B containing for materials to be mixed, are divided into two rectangular portions whose longer sides are in the X direction at the inlet point P1. Then, the lengths of the rectangular portions in the X direction gradually become shorter as shown in ETG. 5 (*b*), and the deformed passages 13 and 14 for the materials A and B to be mixed change into a square shape at the intermediate point P3 as shown in FIG. 5(*c*). The deformed passages 13 and 14 thereafter gradually merge because the holes 15*c* are formed in the partition member 15 between the deformed passages 13 and 14, as described above. The materials A and B to be mixed therefore merge together as shown in FIG. 5(*d*). The deformed passages 13 and 14 are completely merged at the outlet point P5, and the materials A and B to be mixed exist in a mutually mixed state at the outlet point P5, as shown in FIG. 5(*e*).

The materials A and B to be mixed that have been mixed by the first passage block 11 are then divided into two rectangular portions whose longer sides are in the X direction at the inlet port of the second passage block 12. The two types of the materials A and B to be mixed thus substantially merge and are divided. The larger the number of stages of the first passage block 11 and the second passage block 12, the greater the number of times that the materials A and B to be mixed are divided and merge together. The degree of mixing therefore becomes higher as the number of stages increases.

That is, the mixing tube 10 forms layers at a theoretical value of $2^N$. Accordingly, the materials A and B, to be mixed can be sufficiently mixed. Furthermore, it is possible to create an agitating effect by generating a plug flow developing from a strong wall surface resistance against the materials A and B to be mixed.

A method of manufacturing the mixing tube 10 will be explained next. First, the first outer frame member 21, the second outer frame member 22, and the partition member 15 are formed. The first outer frame member 21 and the second outer frame member 22 are each formed by vacuum formation in a shape having voids that become the deformed passages 13 and 14 of the passage block 11, and the deformed passages 16 and 17 of the passage block 12, respectively. The term of vacuum formation denotes a formation method in which a planar sheet plate is vacuum aspirated into a metal heated mold to be deformed. Note that although each of the members is formed by vacuum formation in this embodiment mode, there are no limitations to the formation method. Various other formation methods can also be used, so long as they are formation methods which can form in desired shapes and the like.

The partition member 15 is in a sheet-like shape, and provided with holes 15*c*, each having a size corresponding to half the size of the passage block 11 or the passage block 12 of the mixing tube 10. At this point, flanges 21*a*, 22*a* and 15*a* are formed in the first outer frame member 21, the second outer frame member 22, and the partition member 15, respectively, at both ends in the longitudinal direction of the respective members. The flanges 21*a* and 22*a* of the first outer frame member 21 and the second outer frame member 22, respectively, sandwich the flange 15*a* of the partition member 15. The ends of the flanges 21*a*, 22*a* and 15*a* of the respective three members are then welded together. The mixing tube 10 according to this embodiment mode can thus be manufactured.

A method of using the mixing tube 10 will be explained next. In the case where the materials A and B to be mixed by using the mixing tube 10, the connection portions 41A and 41B of the two containers 40A and 40B for materials to be mixed, respectively, are each connected to the injection port 18 of the mixing tube 10, as shown in FIG. 1.

Next, the materials A and B to be mixed that are contained in the two containers 40A and 40B are squeezed out by continuously squeezing each of the two containers 40A and 40B from a rear side to a front side. The containers for materials 40A and 40B containing to be mixed are made from vinyl, silicon, or similar material that is capable of being squeezed with a predetermined force, and therefore the squeezing operation may be performed manually by hand. A jig such as a tube squeezer may also be used. The materials A and B to be mixed thus squeezed out are then each injected from the injection port 18 of the mixing tube 10 to the deformed passages 13 and 14 of the first passage block 11 of a first stage.

Thus injected into the first passage block 11, the materials A and B to be mixed are then squeezed out from the discharge port 19 by continuously squeezing the mixing tube 10 from the inlet port toward the outlet port.

Dividing and merging together of the materials A and B to be mixed are repeatedly performed by means of the deformed passages 13 and 14 of the first passage block 11, and the deformed passages 16 and 17 of the second passage block 12 at this point as described above. Each of the deformed passages 13, 14, 16, and 17 is squeezed, and localized shear forces thus act on the materials A and B to be mixed. Consequently, mixing is sufficiently performed.

Figure 7:
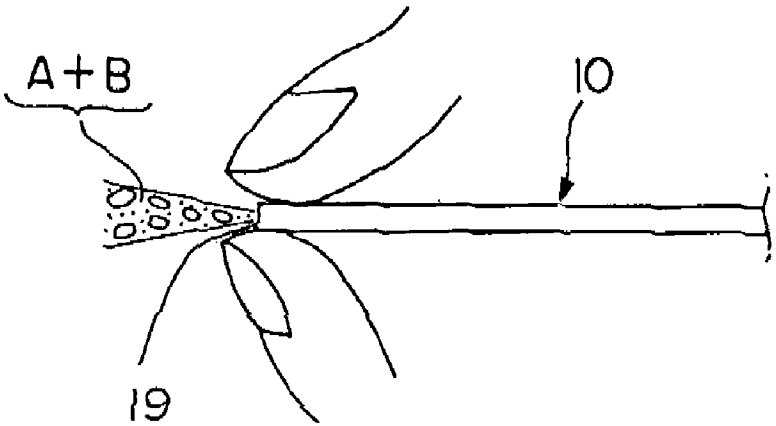
FIG. 7 is a diagram explaining a method of using the mixing tube according to the embodiment mode of the present invention.

Further, the materials A and B to be mixed in the mixing tube 10 can be completely squeezed out by fully squeezing the tube to the tip of the end of the discharge port 19 thereof, as shown in FIG. 7. Residue of materials within the mixing tube 10 can thus be eliminated.

As described above, the mixing tube 10 of the present invention is formed by using a material capable of being squeezed manually by hand with a predetermined force. Accordingly, the materials A and B to be mixed in the mixing tube 10 can be substantially completely squeezed out in a mixed state by continuously squeezing the mixing tube 10 from the inlet port side toward the outlet port side.

It should be noted that, although the mixing tube is squeezed by hand in this embodiment mode, it becomes possible to efficiently mix the materials to be mixed if a jig or similar device is used, provided that the jig or similar device is capable of sandwiching the mixing tube from both side surfaces, continuously squeezing the mixing tube.

Embodiment 1

Figure 8:
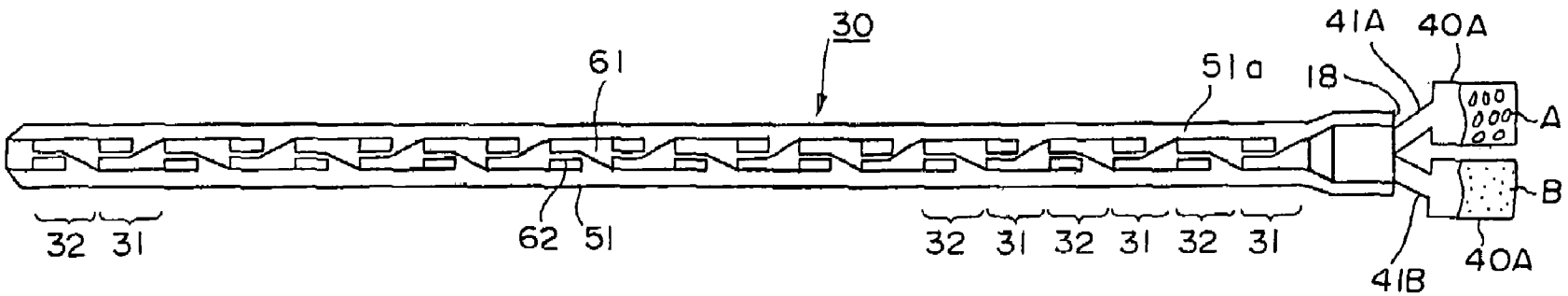
FIG. 8 is a plan view of a mixing tube according to a first embodiment.

A first embodiment will be explained next, based on the drawings, wherein a mixing tube 30 is provided with intermediate partitions at which the deformed passages 13 and 14 of the first passage blocks 11, and the deformed passages 16 and 17 of the second passage blocks 12, respectively, of the mixing tube 10 are each divided. FIG. 8 is a plan view of the mixing tube 30 according to the first embodiment. The mixing tube 30 is a tube that mixes the two types of materials A and B to be mixed having fluidity, similar to the mixing tube described above. The mixing tube 30 is an embodiment in which the shapes of the deformed passages 13, 14, 16 and 17 of the mixing tube 10 are modified. Other structures are similar to those of the mixing tube 10, and therefore explanations of such structures are omitted here.

Figure 9:
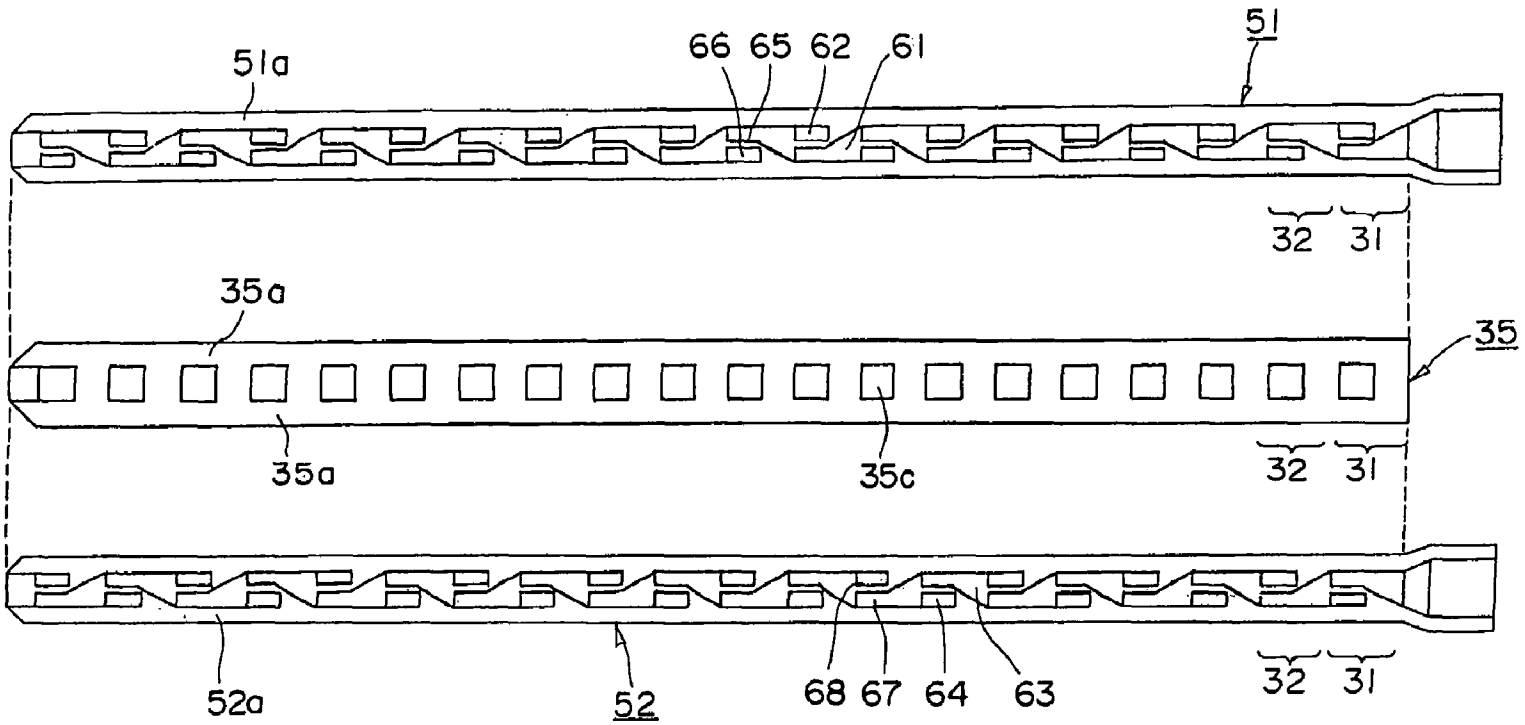
FIG. 9 is a plan view in which the mixing tube according to the first embodiment is exploded into a first outer frame member, a second outer frame member, and a partition member.

The mixing of tube 30 consists of two types of passage blocks of first passage blocks 31 and second passage blocks 32, connected alternately and in series. Deformed passages 61, 62, 63 and 64 that are used for mixing, and deformed passages 65, 66, 67 and 68 that are used for mixing, are formed in the first passage blocks 31 and the second passage blocks 32, respectively. The deformed passages are formed by the intermediate partitions formed in a partition member 35 that is interposed between a first outer frame member 51 and a second outer frame member 52 that divide the mixing tube 30 vertically in a direction through which the materials to be mixed pass. And by intermediate partitions 51*b* and 51*c*, and 52*b* and 52*c* formed in the first outer frame member 51 and the second outer frame member 52. FIG. 9 is a plan view in which the mixing tube 30 is exploded into the first outer frame member 51, the second outer frame member 52, and the partition member 35.

The first outer frame member 51 has voids where the deformed passages 61 and 62 of the first passage blocks 31 and the deformed passages 65 and 66 of the second passage blocks 32 are formed. Flanges 51*a* for welding and adhering to the second outer frame member 52 and the partition member 35 are provided in the first outer frame member 51 at both ends in the longitudinal direction thereof. The intermediate partitions 51*b* are provided in the first outer frame member 51 to divide the first passage block 31 into the two deformed passages 61 and 62. The intermediate partitions 51*b* are formed by benting the first outer frame member 51 so as to divide the first passage blocks 31. The sectional shape of the first outer frame member 51 at a location where the intermediate partitions 51*b* are provided has a substantially "M" shape. Further, the intermediate partitions 51*b*, each has a length that is half the length of the first passage block 31. The materials to be mixed can thus be divided into two portions and discharged from the first passage blocks 31 to the adjacent second passage blocks 32. In addition, the intermediate partitions 51*c* are provided in the first outer frame member 51, dividing the second passage blocks 32 into the two deformed passages 65 and 66.

The second outer frame member 52 has voids where the deformed passages 63 and 64 of the first passage blocks 31 and the deformed passages 67 and 68 of the second passage blocks 32 are formed. Flanges 52*a* for welding and adhering to the first outer frame member 51 and the partition member 35 are provided in the second outer frame member 52 at both ends in the longitudinal direction thereof. Further, the intermediate partitions 52*b* and 52*c* are formed in order to divide the second outer frame member 52 into the deformed passages, similar to the first outer frame member 51. The holes 35*c*, each having a size corresponding to half the size of each of the passage blocks are formed at a fixed spacing in the partition member 35. Flanges 35*a* for welding and adhering to the first outer frame member 51 and the second outer frame member 52 are formed in the partition member 35 at both sides in the longitudinal direction thereof.

Figure 10:
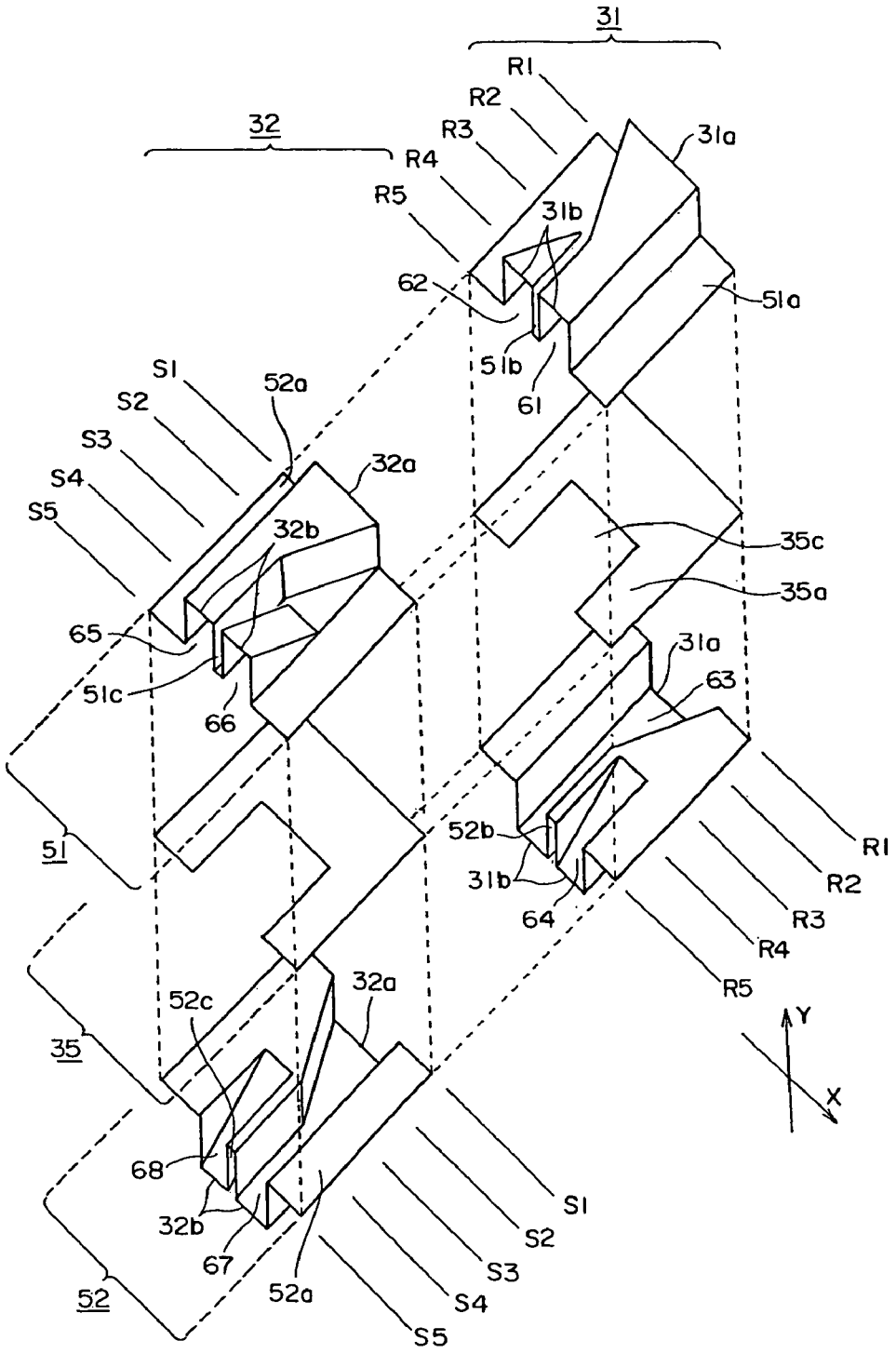
FIG. 10 is a perspective view that shows a first passage block and a second passage block of the mixing tube according to the first embodiment.
Figure 11A:
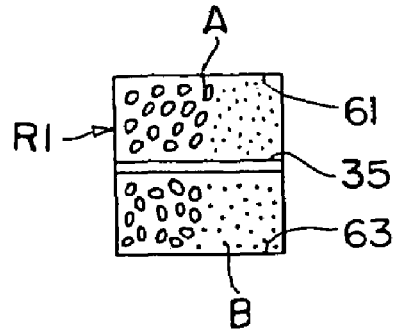
FIGS. 11A to 11E are diagrams explaining mixing states of the first passage block of the mixing tube according to the first embodiment.
Figure 11B:
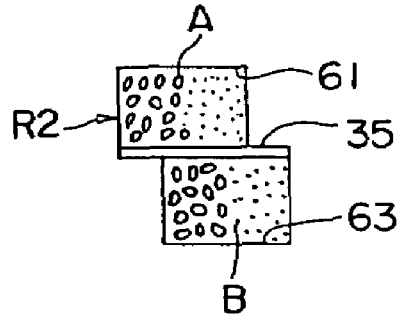
Figure 11C:
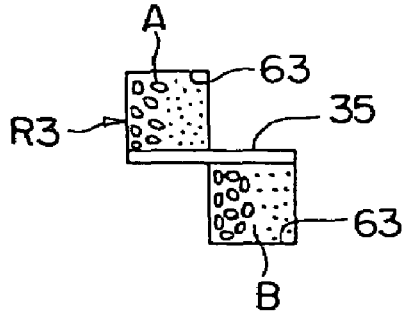
Figure 11D:
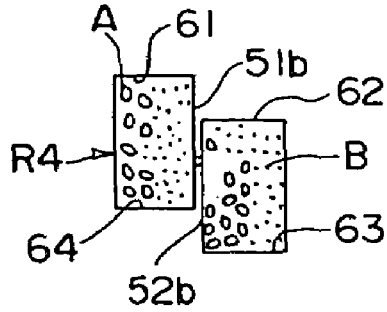
Figure 11E:
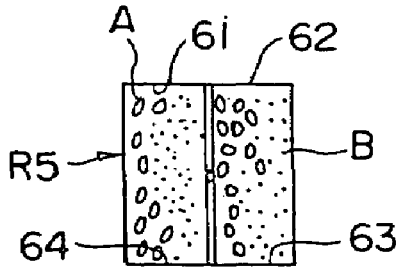

FIG. 10 is a perspective view in which the first passage block 31 and the second passage block 32 are exploded into separate deformed passages. An inlet port 31*a* of the first passage block 31 has a square shape, and is formed by the rectangular deformed passages 61 and 63 whose longer sides are in the X direction overlap. Further, an outlet port 31*b* of the first passage block also has a square shape, and is formed by four deformed passages 61, 62, 63 and 64. The holes 35*c* are formed in the partition member 35 that is disposed between two of the passages in the outlet port 31*b*. The four deformed passages therefore each communicate with an adjacent deformed passage in a Y direction. That is, the deformed passage 62 and the deformed passage 63 communicate, and the deformed passage 61 and the deformed passage 64 communicate, thus forming rectangular passages whose longer sides are in the Y direction.

The sectional shape and the sectional area of the deformed passages 61 and 63 that form the inlet port 31*a* change continuously from an inlet point R1 toward an outlet point R5. The deformed passages 61 and 63 take on short sided square shapes at an intermediate point R3, and maintain the same shapes until reaching the outlet port. The intermediate partitions 51*b* and 52*b* are formed in the first outer frame member 51 and in the second outer frame member 52, respectively, from the intermediate point R3 to the outlet point R5. The deformed passages 62 and 64 are formed adjacent to the deformed passages 61 and 63 from the intermediate point R3 to the outlet point R5. The deformed passages 62 and 64 have inclined surfaces, and the sectional area of each of the inclined surfaces gradually becomes larger from the intermediate point R3 toward the outlet point R5. Further, the holes 35*c* are formed in the partition member 35 from the intermediate point R3 to the outlet point R5. The deformed passages 62 and 63 are adjacent in the Y direction, and therefore, merge at the outlet port, and the deformed passages 61 and 64 that are adjacent in the Y direction merge at the outlet port.

Next, the second passage blocks 32 have the deformed passages 65, 66, 67 and 68. The deformed passages of the first outer frame member and the second outer frame member of the first passage blocks 31 are inverted around the Y direction. At connection between the first passage block 31 and the second passage block 32, the deformed passages 61 and 62 of the first passage block 31 on upstream side communicate with the deformed passage 65 of the second passage block 32 on downstream side. The deformed passages 63 and 64 of the first passage block 31 communicate with the deformed passage 67 of the second passage block 32.

According to the mixing tube 30 thus configured, the materials A and B to be mixed that are mixed in the first passage block 31 are then divided in half in the deformed passages 65 and 67 of the second passage block 32. The materials A and B to be mixed are mixed within the deformed passages 65 and 67 from an inlet point S1 to an intermediate point S3. From the intermediate point S3 to an outlet point S5, the deformed passage 65 and the deformed passage 68 merge at the outlet port, and the deformed passage 67 and the deformed passage 66 merge at the outlet port. The materials A and B to be mixed are thus mixed. Repeating the dividing procedure allows uniform mixing of the materials A and B to be mixed.

Mixing states when the materials A and B to be mixed pass through the first passage blocks 31 and the second passage blocks 32 that are connected in series will be explained next. States where the materials A and B to be mixed pass through the first passage block 31 are shown in FIGS. 11(*a*) to 11(*e*). Note that the reference symbols R1 to R5 in FIGS. 11(*a*) to 11(*e*) correspond to material passage positions of the first passage block 31 in FIG. 10, and are sectional views in the material passage positions as seen from the inlet port. Further, the reference symbols A and B denote the materials to be mixed.

The materials A and B to be mixed that are injected into the first passage block 31 from the containers 40A and 40B containing materials to be mixed are divided into two deformed passages 61 and 63 each having a rectangular shape with longer sides are in the X direction at the inlet point R1, as shown in FIG. 11(*a*). The lengths in the X direction then gradually become shorter as shown in FIG. 11(*b*), and the deformed passages 61 and 63 for the materials A and B to be mixed change into a square shape at the intermediate point R3 as shown in FIG. 11(*c*). Thereafter, the deformed passages 61 and 64, and the deformed passages 62 and 63 gradually merge, respectively. The materials A and B to be mixed merge together as shown in FIG. 11(*d*). At the outlet point P5, the deformed passages 61 and 64, and the deformed passages 62 and 63, form the rectangular outlet ports 31*b* tat are long in the Y direction, as shown in FIG. 11(*c*).

The materials A and B to be mixed that have been mixed by the first passage block 31 are then divided into two deformed passages 65 and 67 each having a rectangular shape with longer sides in the X direction at the inlet port 32*a* of the second passage block 32. The two types of the materials A and B to be mixed thus substantially merge together and are divided. The larger the number of stages of the first passage block 31 and the second passage block 32, the greater the number of times that the materials A and B to be mixed are divided and merge together. The degree of mixing therefore becomes higher as the number of stages increases. That is, the mixing tube 30 forms layers at a theoretical value of $2^N$. Accordingly, the materials A and B to be mixed can be sufficiently mixed.

A method of manufacturing the mixing tube 30 will be explained next. First, the first outer frame member 51, the second outer frame member 52, and the partition member 35 are formed. The first outer frame member 51 and the second outer frame member 52 are configured such that the deformed passages of the first passage blocks 31 and the second passage blocks 32 are formed while forming the respective intermediate partitions 51*b*, 51*c*, 52*b* and 52*c*. The partition member 35 has a sheet-like shape, and the holes 35*c* each having a size that is half the length of each passage block 31 or each passage block 32 of the mixing tube 30 are formed. At this time flanges 51*a*, 52*a* and 35*a* are formed in the first outer frame member 51, the second outer frame member 52, and the partition member 35, respectively, at both ends in the longitudinal direction of the respective members. The ends of the flanges 51*a*, 52*a* and 35*a* of the respective three members are then welded together, the flanges 51*a* and 52*a* of the first outer frame member 51 and the second outer frame member 52, respectively, sandwiching the flanges 35*a* of the partition member 35. The intermediate partitions 51*b* and 51*c* of the first outer frame member 51, and the intermediate partitions 52*b* and 52*c* of the second outer frame member are also welded together. The mixing rube 30 according to the first embodiment can thus be manufactured.

Embodiment 2

Another embodiment of a mixing tube will be explained based on the according drawings in which joining portions 35*d* are provided in the partition member 35 of the mixing tube 30, the joining potions contacting the intermediate partitions 51*b* and 51*c* of the first outer frame member 51 and the intermediate partitions 52*b* and 52*c* of the second outer frame member 52. The mixing tube according to the second embodiment differs from the mixing tube 30 according to the first embodiment only in the shape of the partition member 35 and the method of manufacturing the partition member 35. The external shape and other structures of the completed mixing tube are similar to those of the mixing tube 30. Reference symbols similar to those of the first embodiment are therefore used here, and explanations of such portions are omitted.

Figure 12:
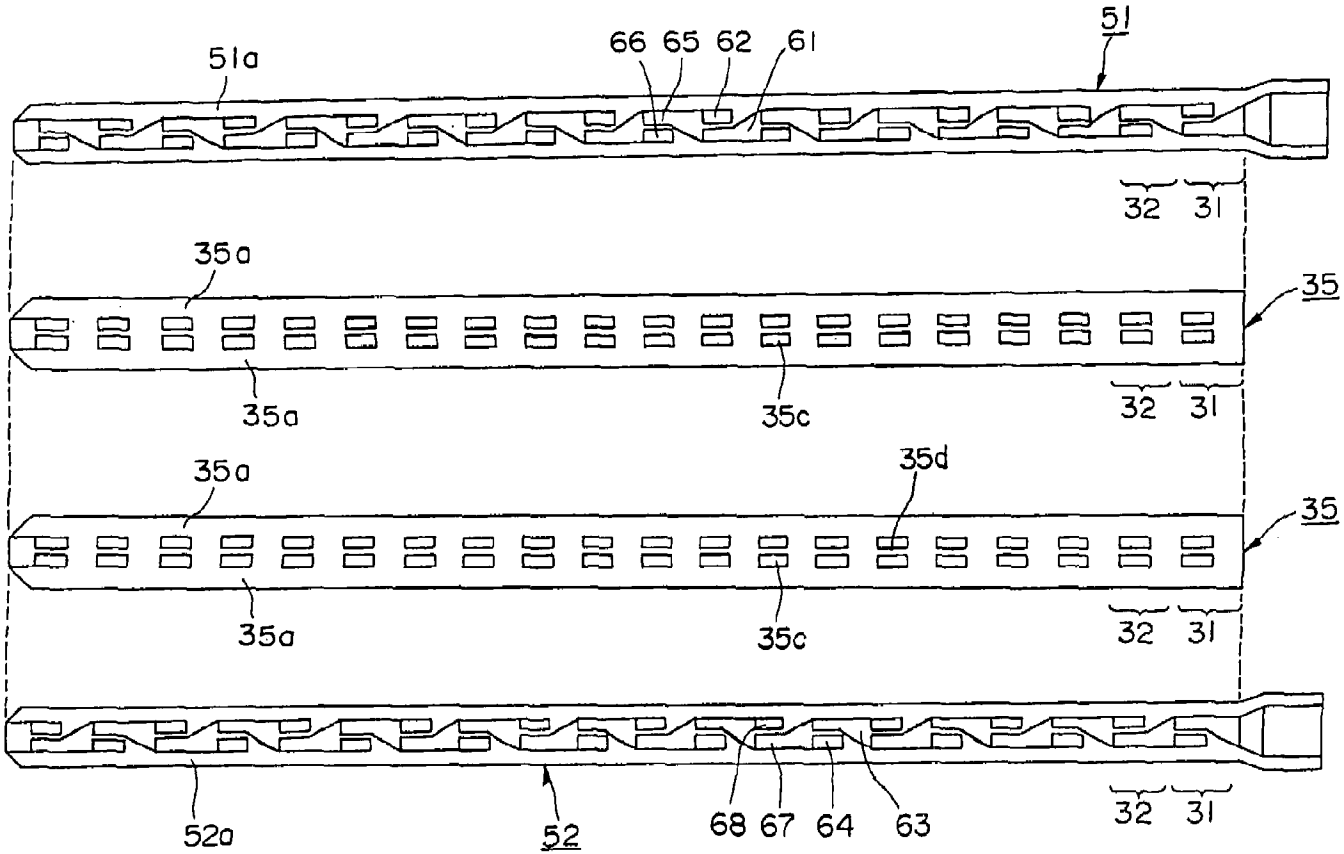
FIG. 12 is a plan view in which a mixing tube according to a second embodiment is exploded into a first outer frame member, a second outer frame member, and partition members.

FIG. 12 is a plan view in which the mixing tube according to the second embodiment is explained into the first outer frame member 51, the second outer frame member 52, and the partition members 35. In the first embodiment, there is only one partition member 35, but in the second embodiment, there are two partition members 35. The joining portions 35*d* that contact the intermediate partitions 51*b* and 51*c* of the first outer frame member 51 and the intermediate partitions 52*b* and 52*c* of the second outer frame member 52 are provided in each of the holes 35*c* of the partition members 35.

A method of manufacturing the mixing tube will be explained next. First, the first outer frame member 51, the second outer frame member 52, and the two partition members 35 are formed. The first outer frame member 51 and the second outer frame member 52 are configured such that the deformed passages of the first passage blocks 31 and the second passage blocks 32 are formed while forming the respective intermediate partitions 51*b*, 51*c*, 52*b*, and 52*c*. The partition members 35 have a sheet-like shape. The holes 35*c* each having a size that is half the length of each passage block 31 or each passage block 32 of the mixing tube 30 are formed while leaving the joining portions 35*d* that contact the intermediate partitions 51*b*, 51*c*, 52*b* and 52*c*. At this time the flanges 51*a*, 52*a* and 35*a* are formed in the first outer frame member 51, the second outer frame member 52, and the partition members 35, respectively, at both ends in the longitudinal direction of the respective members. The flanges 35*a* of the first outer frame member 51 and the flanges 35*a* of one of the two partition members 35 are then welded. Further, the flanges 35*a* of the other partition member 35 and the flanges 52*a* of the second outer frame member 52 are welded. The adhering outer first frame member 51 and the one partition member 35, and the adhering second outer frame member 52 and the other partition member 35, are then welded. The mixing tube can thus be manufactured while forming the intermediate partitions that divide each of the deformed passages. It should be noted that only the flanges 51*a*, 52*a*, and 35*a* of the first outer frame member 51, the second outer frame member 52, and the partition members 35, respectively, are welded to one another in the second embodiment. However, the intermediate partitions 51*b*, 51*c*, 52*b*, and 52*c*, and the joining portions 35*d* of the partition members 35 may also be welded in addition to welding of the flanges 51*a*, 52*a*, and 35*a*, in the second embodiment.

It should be noted that the sectional areas and the sectional shapes of the first passage block and the second passage block all change continuously in this embodiment. However, the mixing tubes 10 and 30 according to the present invention are not limited to this configuration. A configuration may also be adopted in which only the sectional shapes or the sectional areas change continuously, thus allowing compressive and shear forces to act on the materials to be mixed that pass through the mixing tube.

What is claimed is:

1. A mixing tube comprising a first mixing passage and a second mixing passage, in each of which a plurality of elements having a sectional shape that changes continuously are connected in series, such that a plurality of types of materials to be mixed pass through the first mixing passage and the second mixing passage, whereby the materials to be mixed are repeatedly divided and aggregated in a passing process;

wherein the first mixing passage and the second mixing passage are formed by a first outer frame member, a second outer frame member, and a partition member is interposed between the first outer frame member and the second outer frame member, the three members dividing the mixing tube in a direction toward which the materials to be mixed pass;

wherein a plurality of holes, each having the same size as one another, are formed at fixed intervals in the partition member in a direction along which the materials to be mixed are mixed, such that the first mixing passage and the second mixing passage repeatedly divide and aggregate due to the holes, thereby repeatedly dividing and aggregating the materials to be mixed so that the materials to be mixed are divided $2^N$ times and merged together; and wherein said mixing tube comprises a soft thermoplastic resin which can be squeezed over its entirety with a predetermined force.

2. The mixing tube according to claim 1, further comprising:

intermediate partitions provided in the first outer frame member and the second outer frame member, the intermediate partitions dividing the first mixing passage and the second mixing passage, wherein the intermediate partitions of the first outer frame member and the second outer frame member are welded in the holes of the partition member.

3. The mixing tube according to claim 1, further comprising:

intermediate partitions provided in the first outer frame member and the second outer frame member, the intermediate partitions dividing the first mixing passage and the second mixing passage, wherein the intermediate partitions of the first outer frame member and the second outer frame member are each welded to the partition member.

4. The mixing tube according to claim 3, further comprising:

joining portions provided in the holes of the partition member, the joining portions contacting the intermediate partitions of the first outer frame member and the second outer frame member, wherein the joining portions are welded to the intermediate partitions of the first outer frame member and the second outer frame member.

5. The mixing tube according to claim 3, further comprising:

flanges provided in joining portions where the first outer frame member, the second outer frame member, and the partition member are joined, the flanges formed along, and outside of, the first mixing passage and the second mixing passage;

wherein the flanges of the partition member are sandwiched by the flanges of the first outer frame member and the second outer frame member, thus integrating the first outer frame member, the second outer frame member, and the partition member and forming the first mixing passage and the second mixing passage.

6. The mixing tube according to claim 1, further comprising:

flanges provided in joining portions where the first outer frame member, the second outer frame member, and the partition member are joined, the flanges formed along, and outside of, the first mixing passage and the second mixing passage;

wherein the flanges of the partition member are sandwiched by the flanges of the first outer frame member and the second outer frame member, thus integrating the first outer frame member, the second outer frame member, and the partition member and forming the first mixing passage and the second mixing passage.

7. The mixing tube according to claim 1, wherein each of the plurality of holes formed in the partition member have a polygonal outer peripheral shape.

* * * * *